United States Patent [19]

Roberts

[11] Patent Number: 5,042,549

[45] Date of Patent: Aug. 27, 1991

[54] WINDOW TREATMENT CROWN

[76] Inventor: Beverly R. Roberts, 395 Castleridge Dr. NE., Atlanta, Ga. 30342

[21] Appl. No.: 475,026

[22] Filed: Feb. 5, 1990

Related U.S. Application Data

[63] Continuation-in-part of Ser. No. 291,970, Dec. 30, 1988, Pat. No. 4,903,394.

[51] Int. Cl.[5] ..... E04F 10/00

[52] U.S. Cl. ..... 160/39

[58] Field of Search ..... 29/445, 527.1, 527.2, 29/458; 52/90, 171, 270, DIG. 10; 108/108; 211/134, 135, 153; 248/235, 236, 250; 160/39, 19, 38, 135; 428/57

[56] References Cited

U.S. PATENT DOCUMENTS

| | | | |
|---|---|---|---|
| 2,530,567 | 11/1950 | Cline | 160/39 |
| 2,636,557 | 4/1953 | Williams | 160/39 |
| 4,246,951 | 1/1981 | Givens | 160/39 |
| 4,378,070 | 3/1983 | Matheis | 211/134 X |

*Primary Examiner*—Timothy V. Eley

*Attorney, Agent, or Firm*—Thomas, Kerr & Kayden

[57] ABSTRACT

A cornice board assembly comprises a face board of expanded plastic foam material and means forming a dust board and side members of expanded plastic material. The boards are joined together with their edges in alignment by means of a water based cement.

17 Claims, 2 Drawing Sheets

WINDOW TREATMENT CROWN

This application is a continuation-in-part of U.S. patent application Ser. No. 07/291,970, filed Dec. 30, 1988, now U.S. Pat. No. 4,903,394, issued Feb. 27 1990.

FIELD OF THE INVENTION

This invention relates to decorative window treatments, and more particularly to a crown for use over windows and doors, and to the method of making such crowns.

BACKGROUND OF THE INVENTION

A cornice board arrangement for use over, for example, a single width (36 inches) window or door generally comprises a face board, facing the room, a dust board extending from the top of the face board back to the wall above the window and first and second side boards at either end of the face and dust boards.

Heretofore, prior art cornice boards of the type described have generally been made of plywood or suitable wood, such as pine, that is inexpensive and easily worked. There are numerous problems involved in making cornices out of wood of any sort, however. In the first place, the wood must be sufficiently thick so that it will not bend, resulting in an unduly heavy and unwieldy cornice, and even with sufficient thickness, the wood still is subject to warping. In addition, because of the weight of the components involved, to ensure structural integrity, in the assembly of the cornice the pieces must be joined together by screws, which are preferable, or by nails, thereby greatly increasing the weight of the cornice assembly while making assembly thereof tedious and time consuming. Other drawbacks to the use of wood are its permeability to moisture, its odor and its attraction to insects.

In the assembly of any wooden window treatment form, the various pieces thereof must be cut to proper size and shape by sawing, which adds to the difficulty of assembly, especially where the window is of a non-standard size, or where a shape other than straight edges is desired, and the individual pieces must be sawed to the proper length or shape. The assembly must then be mounted into position over the window, for example, which requires mounting brackets of sufficient strength to hold the heavy form which are mounted to the wall, for example, above the window. Because of the weight of the window treatment form, e.g., cornice assembly, such brackets must be mounted to the wall by toggle bolts or molly bolts, preferably the former, and screwed to the cornice assembly. Such a mounting arrangement is extremely difficult for one person to accomplish because of the weight and unwieldiness of the assembly. If, subsequently, it is necessary to remove the assembly, the reverse process is necessary, i.e., unscrewing all of the mounting screws joining the brackets to the cornice, and lifting the heavy form off of the brackets. Removal of the brackets themselves leaves large, unsightly holes in the wall.

It is customary to cover the exterior of the form with decorative fabric, which, because of the hardness of the wood surface, has to be stapled or tacked into place on the cornice. Thus, if at some future time it is necessary to remove the fabric for cleaning, for example, the tedious and potentially fabric damaging process of removing the staples is necessary, with no assurance that the fabric will remain undamaged so that it may be cleaned and reused.

SUMMARY OF THE INVENTION

The present invention comprises a top window treatment crown which overcomes, to a large degree, the shortcomings and drawbacks of the prior art, as set forth in the foregoing.

The crown embodying the principles of the present invention comprises a face board of rigid foamed plastic material, such as, for example, dense expanded polystyrene.

Such material is extremely light in weight, as compared to wood or plywood, is water resistant, unaffected by normal temperature swings, odorless, does not attract insects, and, above all, possesses extremely high physical strength and dimensional stability as compared to wood of similar dimensions.

The face board is cut to appropriate size and shape by knife, razor or similar tool. In practice, the component boards of the assembly may be hot-wire cut from large pieces of the foam material. In like manner, a dust board is cut to appropriate size, as are the two side boards. The side boards are cut so that their height is the same as the height of the face board less the thickness of the dust board, while the depth of the side boards are the same as the depth of the dust board.

The leading edge of the dust board is then bonded to the rear surface of the face board, at the top thereof and flush with the top edge by depositing a continuous stream of non-chemical solvent adhesive, such as a water based cement, along the leading edge of the dust board, and the two parts are held in alignment until the adhesive sets sufficient to maintain the junction. For simplicity, the face may be laid face down on a flat surface with the dust board extending upwardly therefrom.

Each side board has two adjacent edges, one of which contacts the underside of the dust board and the other of which contacts the rear face of the face board along the edges of both boards. A continuous line of adhesive, such as a bead of cement is deposited on each of these edges and each side board is pressed into place and held while the cement sets sufficiently to maintain the junctions.

Right angle brackets of a material such as high impact polystyrene are provided for mounting the crown to the wall over the window. These brackets, usually no more than two because of the light weight of the window crown, can be attached to the wall by ordinary nails or screws, or by double sided adhesive tape, inasmuch as molly or toggle bolts are generally not necessary, thereby minimizing damage to the wall. The window crown rests on the brackets and is stabilized by elongated thumb tacks, which pass through holes in the brackets and are thumb or hand pushed into the polystyrene foam of the window crown.

The crown thus assembled comprises a unit having a seamless front, with a dust board extending rearwardly from the top rear edge of the face board, and first and second side boards extending downwardly from the bottom of the dust board, at each end thereof, and rearwardly from the rear of the face board at the ends thereof. All junctions between the various boards are flush so that the entire assembly is smooth and devoid of irregular junctions.

Covering the crown with, for example, a decorative fabric, likewise is quite simple and requires only a pair of scissors for trimming the material. The material is laid over the outer faces of the board, dust board and side boards, wrapped around the bottom edges thereof, and fastened into place on the rear surfaces of the boards by means of trim pins, which are two-pronged pins having small shoulders formed in each prong. The pins are driven into place by thumb pressure and held in place by the shoulders and their own natural resiliency.

When the face board is used, the crown produces an effect similar to a cornice. Elimination or removal of the face board produces a crown having an appearance and effect similar to a valance.

In a second preferred embodiment, the crown of the present invention comprises a palladian unit wherein the face board has an arched, substantially semi-circular configuration and the side boards and dust board are formed from a single curved board extending from the rear side and top edge of the face board. The single curved board may be fabricated from a plurality of curved board units, cemented or otherwise attached end to end to each other to form a curved or semi-circular arch at the rear of the face board.

A mounting board is inserted within the arch and extends from one side to the other, being cemented or otherwise attached at its ends to the interior surface of the curved board. To insure a strong junction, the ends of the mounting board are contoured to match the curve of the curved board.

The invention and the numerous features and advantages thereof will be readily apparent from the following detailed description, read in conjunction with the following drawings, in which.

DETAILED DESCRIPTION OF THE DRAWINGS

Figure 1:
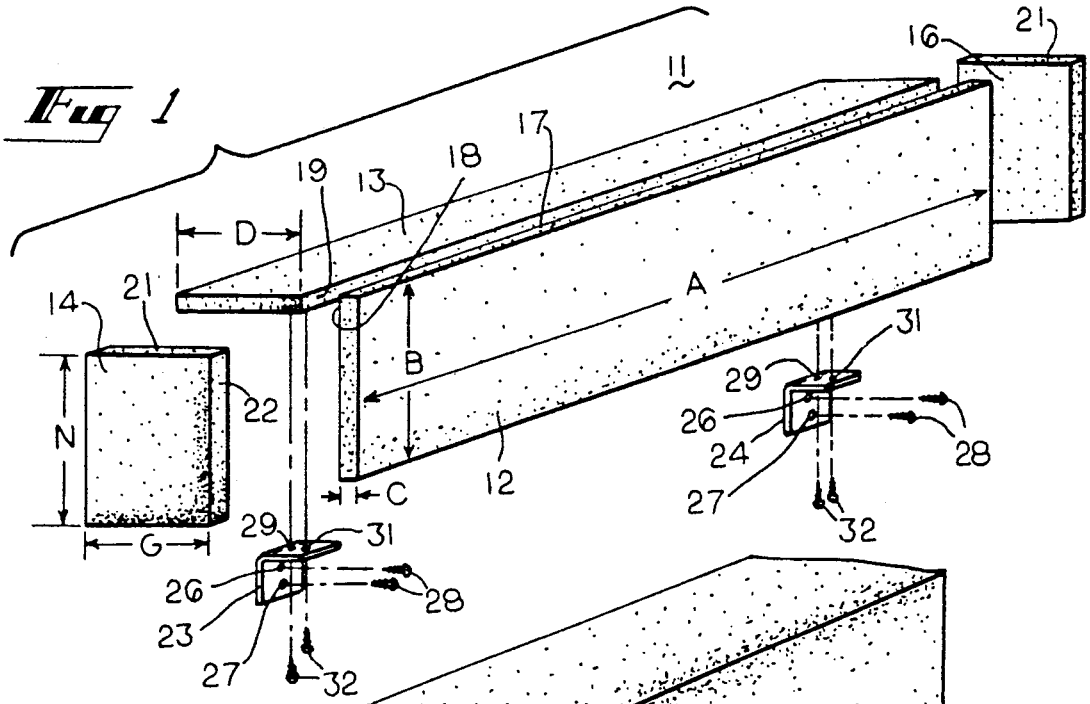
FIG. 1 is an exploded, perspective view of the window treatment crown embodying the principles of the present invention.

In FIG. 1 there is shown the relationship of the various components of the window treatment crown 11 of the present invention, from which the method of assembling the crown is apparent. Form 11 comprises a face board 12 of a rigid foamed plastic material, such as for example, dense expanded polystyrene. As illustrated in FIG. 1, the crown is intended to fit over a standard thirty-six inch window, and to this end the face board is cut to a length dimension (A) of approximately forty-four inches. The height (B) of the crown is cut to a length of approximately fifteen inches, and the thickness (C) is approximately one inch. This thickness is adequate to ensure an extremely stiff face board 11, with a weight approximately one-tenth to one-twentieth that of a wood board of similar dimensions.

A dust board 13 is attached to the top or outer edge 17 of board 12 against the inside face 18 thereof and is the same length as face board 12 and is also approximately one inch thick. The depth (D) of board 13 may be made any desired dimension, five inches, for example, representing the usual depth for a dust board of a cornice having the dimensions set forth. For attachment the front edge 19 of board 13 has deposited thereon a continuous stream of adhesive or bead of cement, not shown, which, as pointed out heretofore is preferably water based to eliminate any possible reaction between the adhesive and the polystyrene. An example of such an adhesive is manufactured by Franklin International, and is designated "Franklin House, Shop and Craft Glue". Front edge 19 is then pressed firmly against face 18 so that the top surface of board 13 and edge 17 are aligned along their length, and held in place until the adhesive commences to set. This gluing process can be simplified by laying the front surface of board 12 down on a flat surface and bonding board 13 thereto so that it extends vertically upwardly therefrom. While it has been found that gluing is a preferred mode of attachment, other attachment means can be used.

First and second side boards 14 and 16 are sized to have their width (G) the same as the depth(D) of board 13, and to have their height (H) one inch less than height (B) of board 12. That is, the height of boards 14 and 16 is equal to the height of board 12 less the thickness of board 13. After the adhesive between boards 12 and 13 has set enough to maintain the junction therebetween, the edges 21 and 22 of board 14 and board 16 have a continuous line of adhesive drawn therealong, and the boards 14 and 16 are mounted in place, as can best be seen in FIG. 2, and held there for enough time to allow the adhesive to set sufficiently to hold the boards 14 and 16 firmly in place.

Figure 2:
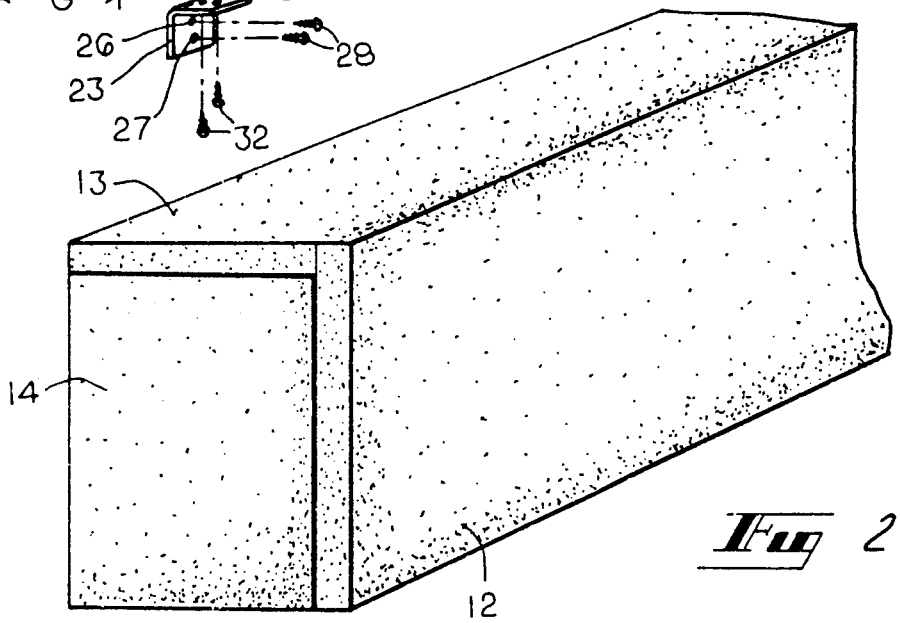
FIG. 2 is a perspective view of an assembled crown.

After the cement has set, the crown, as best seen if FIG. 2, is ready to be mounted. To this end, as seen in FIG. 1, a pair of right angle brackets 23 and 24 of a suitable plastic material such as high impact polystyrene are provided. Each of brackets 23 and 24 has drilled in the depending leg a pair of vertically offset separated nail or screw holes through which nails or screws 28, 28 pass for mounting the bracket to the wall above the window. Inasmuch as crown 11 actually weighs considerably less than, for example, a small framed picture, the anchoring of screws 28, 28 is not necessary, although some form of anchoring may be used.

Crown 11 is attached to the brackets 23 and 24 to rest upon the outwardly extending legs thereof by means of elongated tacks 32, 32 which extend through holes 29 and 31 in the bracket, and are pressed into the dust board 13 through the underside thereof. Because of the light weight of the crown, only one tack per bracket is necessary.

Figure 3A:
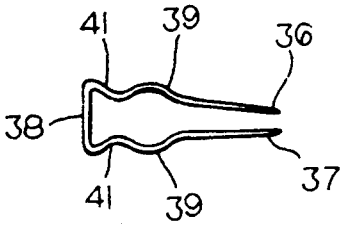
FIG. 3A is a detail of the arrangement of FIG. 3.
Figure 3:
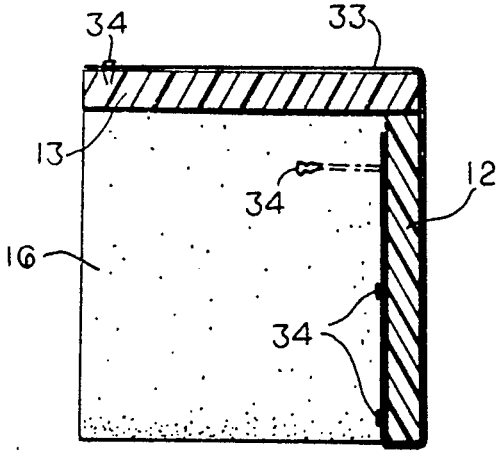
FIG. 3 is a sectional elevation view of the window treatment crown having a decorative fabric mounted thereon.

When it is desired to cover the crown 11 with, for example, a decorative fabric, it is a simple matter to remove tacks 32, 32 and lift the crown off of the brackets. In FIG. 3 there is shown a cross-section of crown 11 having a layer 33 of fabric thereon. As can be seen, the material is anchored to board 13 at the rear top thereof by means of trim pins 34, and is stretched down over the front face of board 12, under the bottom edge thereof, and up the rear surface, where it is likewise anchored by means of one or more pins 34. As can be seen in FIG. 3A, pins 34 comprise a pair of prongs 36 and 37, joined at one end by a cross piece 38. The prongs 36 and 37 are shaped to have a shoulder 39 near the end joined by piece 38, forming indentation 41 in each prong. Pins 34, which are commercially available, are virtually ideal for use with the arrangement of the present invention, since the foam material grips the pins at the recess 41 when the pin is pushed into place.

If it is desired, a layer of padding, not shown, may underlie fabric 33 and overly boards 12 and 13 to give a more rounded effect, and to relieve the harshness of the square corners.

As pointed out heretofore, the crown piece of the present invention can be used to produce the effect of a cornice or, upon removal of the face plate 12, the effect of a valance.

Figure 4:
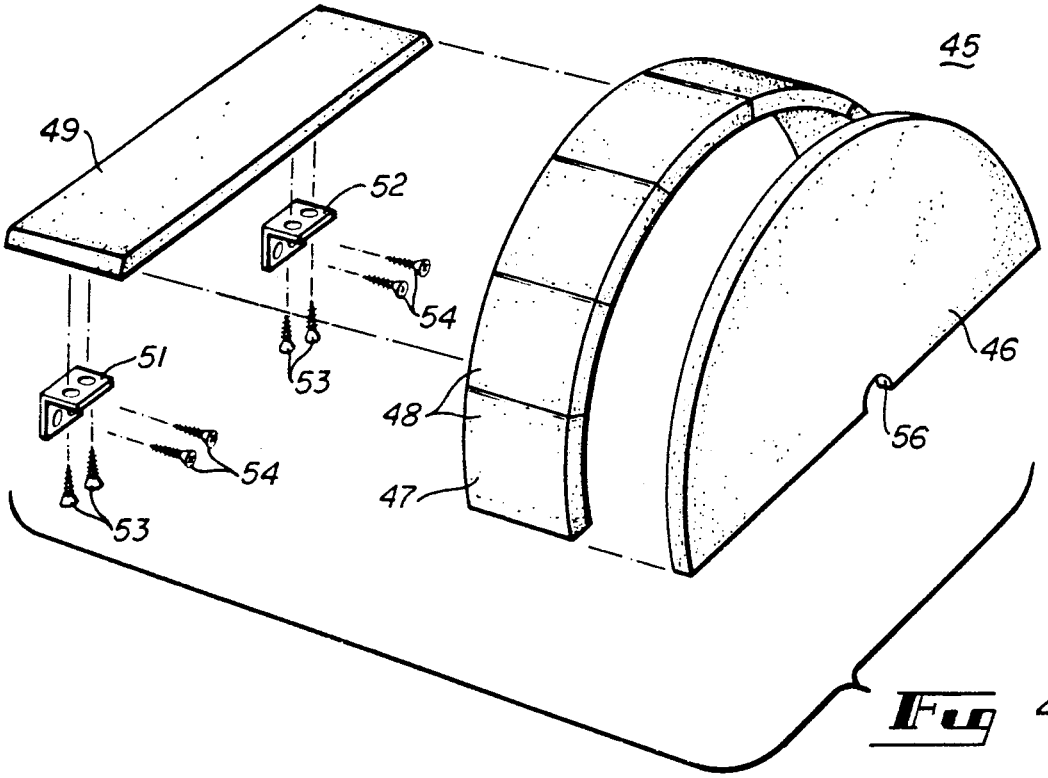
FIG. 4 is an exploded perspective view of the window treatment crown as a palladian unit.

In FIG. 4 there is shown the window treatment crown of the present invention as embodied in a palladian unit 45.

Unit 45 comprises a face board 46 of foamed plastic material which is cut in a curved, substantially semicircular shape, as shown. As was the case with the crown 11 of FIG. 1, face board 46 is approximately one inch thick. Mounted to the rear of face board 46 flush with the outer edge thereof and extending rearwardly therefrom is a curved board 47 which may be formed from a plurality of short curved boards 48, 48, joined end to end to form an arch which matches the curvature of face board 46. The curve of board 47 may be fabricated in any of a number of ways, that shown here being by way of example only. As previously mentioned, the various parts of the assembly of the present invention preferably are joined using a water based cement. However, the mounting of curved board 47 to the rear of face board 46 may be by means other than water based glue.

Figure 5:
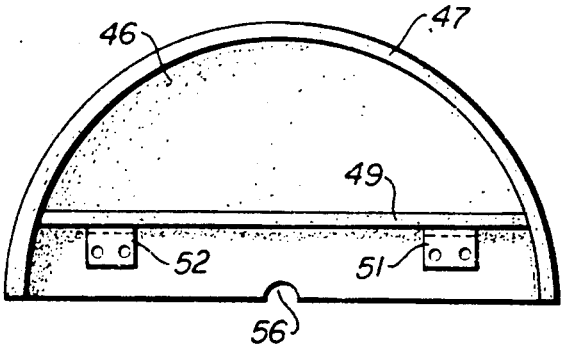
FIG. 5 is a rear elevation view of the unit of FIG. 4.

It can be seen that, when mounted in place on face board 46, with its outer or upper surface flush with the outer or side and upper edge of board 46, curved board 47 functions as both the dust board and side boards of the embodiment of FIGS. 1 through 3. However, because of its curved form, it cannot serve as a mounting means for the unit 45. In order that unit 45 might be mounted in a manner similar to that of the crown of FIGS. 1 through 3, a mounting board 49 is provided having a length less than the base length of the arch of curved board 47. As a consequence, board 49 fits within the arch above the base thereof as best seen in FIG. 5, and extends across from one inner or bottom surface to the opposite of board 47. Since it is desired that board 49 be fixed in place, as by gluing, its ends are contoured to fit the curvature of board 47 for maximum contact therewith.

Palladian unit 45 is preferably mounted over a window or door in the same manner as is shown in FIGS. 1 through 3. To this end mounting brackets 51 and 52 are attached to mounting board 49 by screws 53, 53, for example, and to the wall by screws 54, 54.

Figure 6:
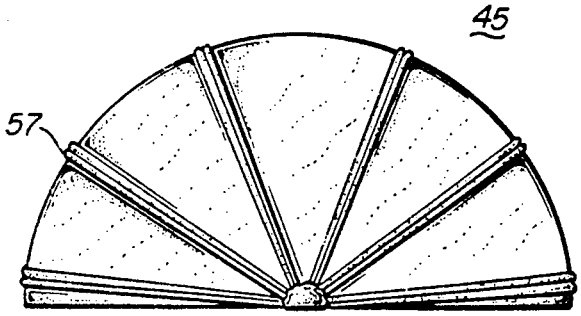
FIG. 6 is a front view of the unit of FIG. 4 covered with a decorative covering.

In order that unit 45 may be covered with decorative material, it is provided with a cut out portion 56, shown as semicircular, although it may take other shapes as well, depending upon the design of the decorative material arrangement. In FIG. 6 the material 57 is shown gathered to form a plurality of rays, and a rosette is located in the cut-out 56. It will be obvious to designers that the palladian arrangement affords a wide range of decorative possibilities.

While the palladian unit has been shown as having an approximately semi-circular shape, it can take other shapes as well, depending upon the decorative requirements.

It can readily be appreciated that the top treatment crown of the invention can be packaged in kit form, with the various parts cut to the proper length, and quickly and easily assembled. Where necessary to shorten the lengths, a kitchen knife, razor blade or Exacto knife would be all that was required The foregoing description has illustrated the principles of the invention in the method of assembling a decorative top window treatment crown, and the crown resulting from the application of the method. Numerous changes or variations of these principles may occur to workers in the art without departure from the spirit and scope of the invention.

What is claimed is:

1. A window top treatment crown assembly comprising:

a face board member of expanded plastic foam material, said member having front and rear surfaces and an outer edge forming side and upper edges, means forming a dust board and side boards, said dust board having top and bottom surfaces mounted to the rear surface of said face board member with its top surface flush with the outer edge of said face board member;

and means for mounting said crown assembly in place.

2. A window top treatment crown assembly as claimed in claim 1 wherein said face board member is substantially semi-circular in shape.

3. A window top treatment crown assembly as claimed in claim 2 wherein said means forming a dust board and side boards comprises a curved board forming an arch coinciding with the semi-circular shape of said face board.

4. A window top treatment crown assembly as claimed in claim 3 and further including a mounting board mounted within said arch.

5. A window top treatment crown assembly as claimed in claim 4 wherein said mounting board is mounted above the base of said arch and extends from one side to the other substantially parallel to said base.

6. A window top treatment crown assembly as claimed in claim 5 wherein said mounting board has first and second ends contoured to match the curvature of said curved board.

7. A window top treatment crown assembly as claimed in claim 1 wherein said means forming a dust board and side boards comprises a first substantially rectangular member mounted to the top of the rear surface of said face board member and first and second side board members mounted on the rear surface of said face board member at the ends thereof.

8. A window top treatment crown assembly as claimed in claim 7 wherein said dust board extends away from said rear surface a distance D and said face board member has a height B, and each of said side boards has a width G and a height N, where G is equal to D and N is equal to B less the thickness of said dust board member.

9. A window top treatment crown assembly as claimed in claim 8 wherein said face board member, said dust board, and said side boards are mounted to each other with glue.

10. A window top treatment crown assembly as claimed in claim 9 wherein said glue is water based.

11. A window top treatment crown assembly comprising a face board having a substantially semicircular shape having an outside edge forming side and top edges, a base edge, and having front and rear surfaces, a curved board mounted to the rear surface of said face board, said curved board having an outer surface flush with the top and side edges of said face board forming an arch, a mounting board mounted within said arch and extending from one side to the other thereof, and mounting means attached to said mounting board.

12. A window top treatment crown assembly as claimed in claim 11 wherein said curved board comprises a plurality of curved sections mounted end to end to form said arch.

13. A window top treatment crown assembly as claimed in claim 11 and further including a cut-out in said base edge.

14. A window top treatment crown assembly as claimed in claim 11 wherein said face board, said curved board, and said mounting board are of expanded plastic foam material.

15. A method of making palladian crown unit for use over windows or doors comprising the steps of:

forming a substantially semi-circular face board having front and rear surfaces and an outer edge forming top, side and base edges, said face board being of expanded plastic foam material, forming a curved board having upper and lower surfaces by connecting a plurality of curved elongated members of expanded plastic foam material end to end to form said curved board into an arch mounting said curved board to the rear surface of said face board with the upper surface thereof flush with the upper and side edges of said face board.

16. The method as claimed in claim 15 and further including the step of mounting within said arch are elongated mounting board.

17. The method as claimed in claim 15 wherein said curved elongated members said curved elongated members are connected end to end by means of glue, and said curved boards mounted to said face board by means of glue.

* * * * *